United States Patent [19]

Horsting et al.

[11] 3,931,661

[45] Jan. 13, 1976

[54] APPARATUS FOR CLEANING AND DISINFECTING INSEMINATION STRAWS

[75] Inventors: Albertus G. Horsting; Samuel Luzaich, both of Santa Rosa, Calif.

[73] Assignee: Tur-Colossus, Inc., Santa Rosa, Calif.

[22] Filed: Aug. 8, 1974

[21] Appl. No.: 495,585

[52] U.S. Cl. ..... 15/308; 15/88

[51] Int. Cl.[2] ..... A46B 13/02

[58] Field of Search ..... 15/88, 104.04, 104.05, 15/304, 406, 308, 309

[56] References Cited

UNITED STATES PATENTS

| | | | |
|---|---|---|---|
| 2,531,009 | 11/1950 | Stuart et al. | 15/88 X |
| 3,045,268 | 7/1962 | Coan | 15/88 |
| 3,765,050 | 10/1973 | Allman et al. | 15/304 |

*Primary Examiner*—Edward L. Roberts

*Attorney, Agent, or Firm*—Gregg, Hendricson, Caplan & Becker

[57] ABSTRACT

Apparatus for scrubbing, rinsing, drying and packaging very fine, hollow cylinders or straws employed in artificial poultry insemination, includes straw transport means moving straws in fixed orientation through successive cycles including interior washing and drying and magazine loading entirely automatically.

7 Claims, 7 Drawing Figures

APPARATUS FOR CLEANING AND DISINFECTING INSEMINATION STRAWS

BACKGROUND OF INVENTION

In the artificial insemination of poultry, such as turkeys, for example, there may be employed very fine, hollow, cylinders which are loaded with a precise amount of semen and a separate straw is then employed for each female fowl in order to ensure application of the desired amount of semen in each artificial insemination operation. These fine, hollow cylinders are termed "straws" and reference is made to U.S. Pat. No. 3,774,578 for "Poultry Insemination Apparatus" containing description of apparatus for the utilization of such straws. Reference is also made to U.S. Patent Application Ser. No. 384,937 for "Straw Charging and Feeding Apparatus," wherein the present invention, A. G. Horsting, is a co-inventor, describing and illustrating apparatus for the loading of fine, hollow cylinders or straws with poultry semen.

The utilization of a separate sterile straw for each artificial insemination operation is highly advantageous in preventing infection or the spread of disease in poultry being operated upon. However, it will be realized that commercial artifical poultry insemination is a very large scale operation involving hundreds of thousands and even millions of fowl. The insemination straws may be formed of a variety of materials such as glass or plastic; however, with even the most inexpensive materials, the very large volume of straws required poses a problem of cost and also supply. Reuse of these straws requires an extremely thorough cleaning disinfecting and again the large number thereof involved necessitates some type of automated process for the efficienct and inexpensive handling thereof.

SUMMARY OF INVENTION

The present invention provides a fully automated system and apparatus for the thorough cleaning and disinfecting of fine cylinders or straws employed in artificial poultry insemination. The apparatus hereof also provides for the thorough drying of the cleaned and disinfected straws and the packaging of same in a magazine so that they may be directly loaded into apparatus such as disclosed in U.S. Patent Application Ser. No. 384,937 noted above, to preclude the possibility of contamination.

The apparatus of the present invention includes a hopper into which straws are dumped and which feeds straws individually in succession therefrom onto transport means which holds each straw in predetermined orientation. The transport means of the present invention moves successive straws through a cleaning and disinfecting cycle wherein the exterior of the straws are scrubbed and the interior of the straws are washed while both interior and exterior are disinfected. The transport means then continues the movement of straws through a rinsing station wherein both the interior and exterior of the straws are thoroughly rinsed. Individual straws after rinsing are then successively moved by the transport means into a drying cycle wherein the interior of each straw is thoroughly dried and the exterior of the straws are dried so that the straws are then individually in condition for further utilization. The dry, cleaned and disinfected straws are automatically loaded by the present invention into a magazine or the like, again in predetermined orientation with each other whereby the magazine may be closed and moved in such condition to straw filling apparatus without being touched by human hands.

The entire system and apparatus of the present invention is automated and the straws thereof move continuously therethrough to provide a high rate of cleaning and disinfecting so that the large numbers of straws may be processed hereby to provide the necessary volume for commercial artificial poultry insemination.

DESCRIPTION OF FIGURES

The present invention is ilustrated as to a single preferred embodiment thereof in the accompanying drawings wherein.

DESCRIPTION OF PREFERRED EMBODIMENT

Figure 1:
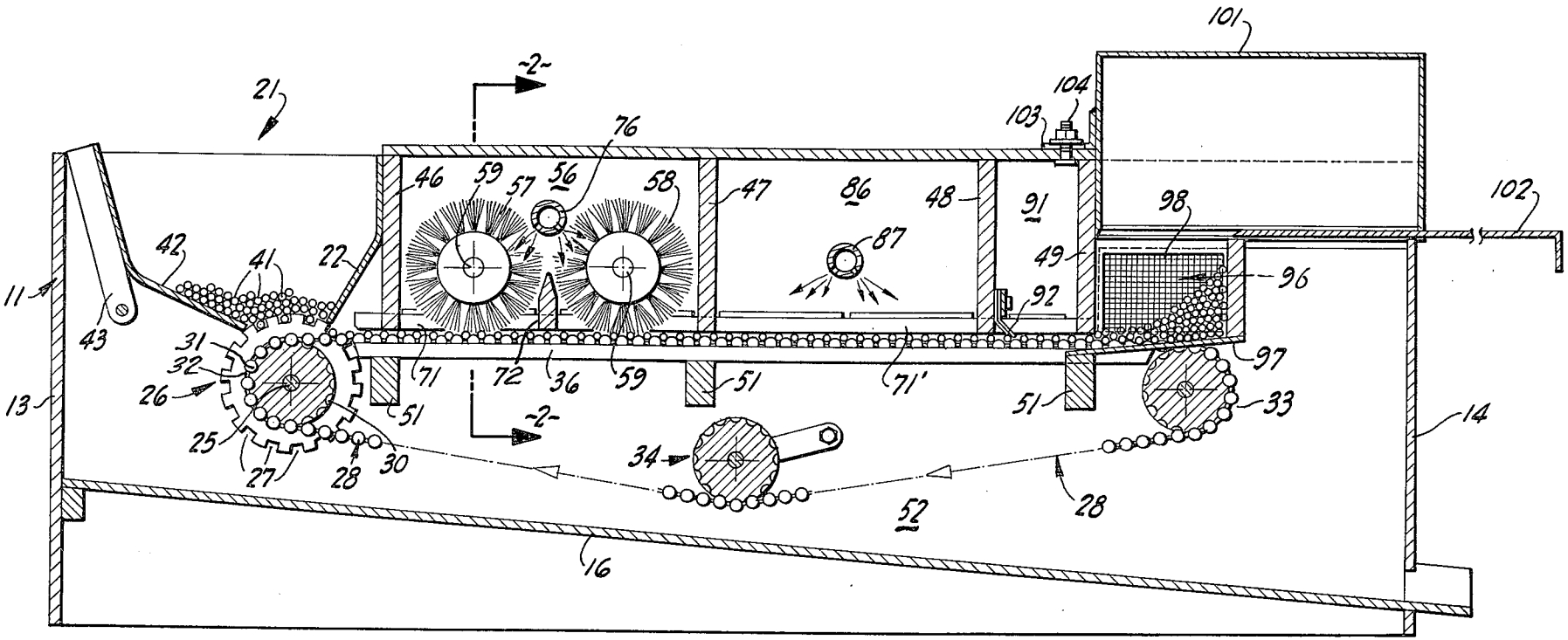
FIG. 1 is a central longitudinal vertical section through a preferred embodiment of the present invention, with the section being offset in the plane of the chain cylinders to illustrate chain drive.

A preferred embodiment of the present invention, as illustrated in the drawings, includes a housing 11 including a vertical back wall 12, front and rear walls 13 and 14 and an inclined bottom 16. A front wall 17 includes a lower fixed portion **17*a* and an upper removable portion 17*b* as shown, for example, in FIG. 2. At the forward end of the apparatus there is provided an inlet hopper 21 having an open top with an inclined back wall 22. At the bottom of the hopper there is provided a rotatably mounted cylinder 26 having peripherally spaced longitudinal notches 27 thereabout. The cylinder 26 extends transversely of the housing between the back and front walls and has a pair of ball chains 28 and 29 disposed thereabout adjacent opposite ends of the cylinder. The chains 28 and 29 extend about the cylinder 26 in circumferential grooves and fit into peripheral indentations 30 in the bottom of these grooves. Each of the chains is composed of a succession of balls or spheres 31 connected by links 32 and such chains may be conventional commercially available items of this type. Balls 31 of the chains and indentations 30 of the cylinder are dimensioned such that the balls fit in the indentations so that the cylinder acts in part as a cog wheel for moving the chains. These chains 28 and 29 extend longitudinally through the housing about a second peripherally indented cylinder 33 mounted for rotation at the rear end of the housing. An idler cylinder 34 is rotatably mounted on a pivotally mounted arm to adjustably tension the chains 28 and 29**.

Figure 2:
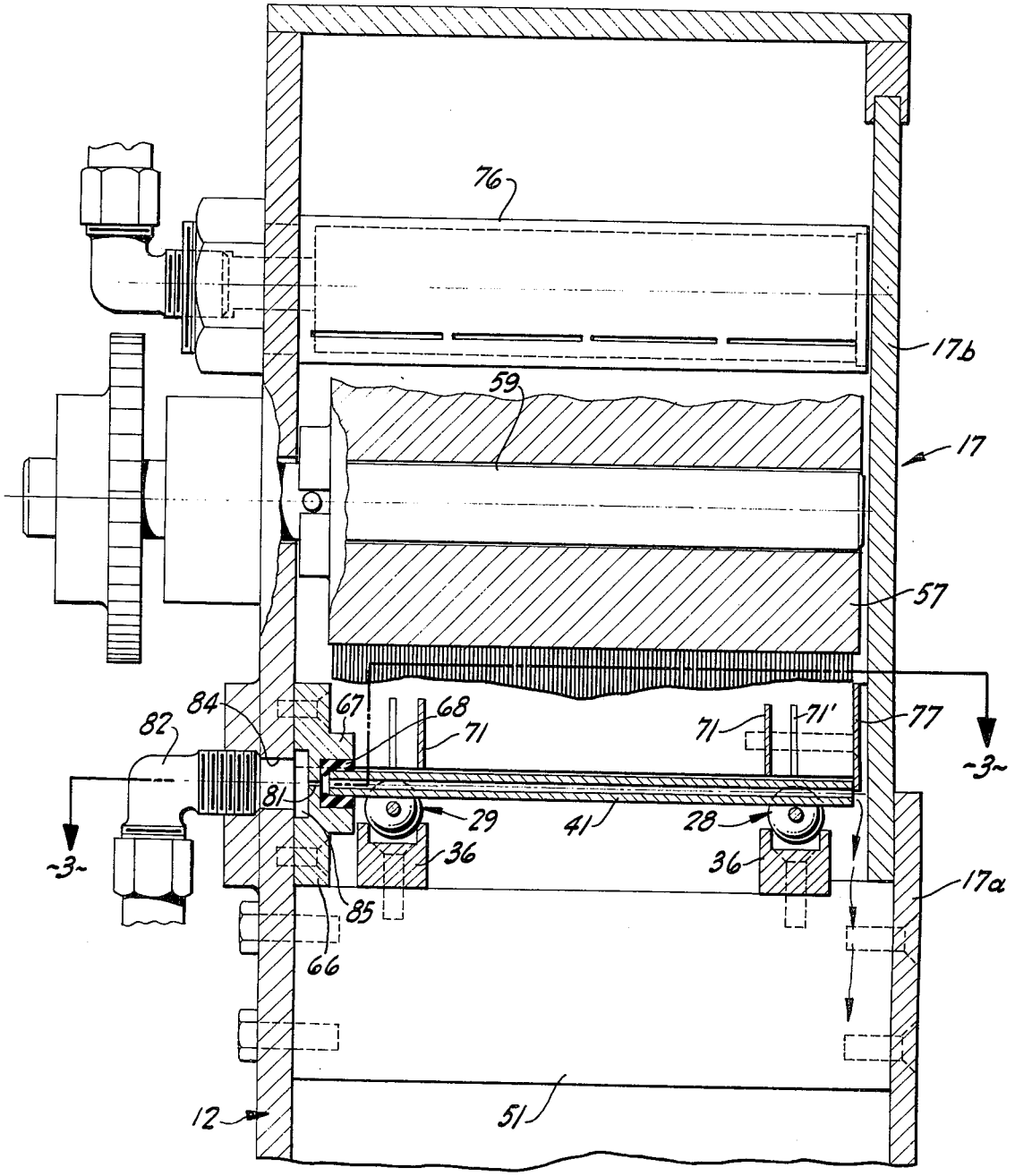
FIG. 2 is a transverse vertical sectional view taken in the plane 2—2 of FIG. 1.
Figure 6:
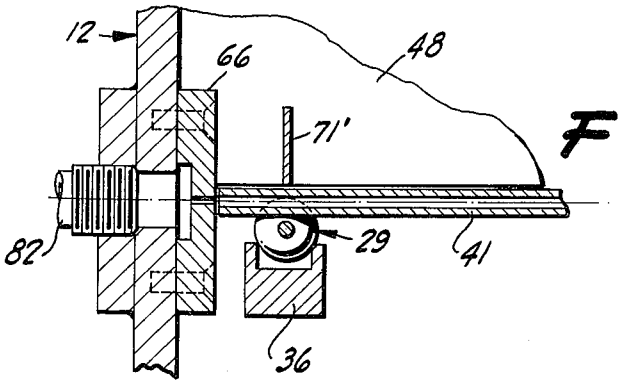
FIG. 6 is a partial sectional view taken in the plane 6—6 of FIG. 3.

The chains 28 and 29 are driven by one of the cylinders 26 or 33 to move continuously through the housing longitudinally thereof and U-shaped chain supports 36 are provided beneath the upper traverse of the chains, as illustrated in FIG. 2, to prevent lateral movement of the chains or sagging thereof. The separation of the individual balls 31 of the chains is just sufficient to accommodate the placement of a straw 41 therebetween upon the link 32 connecting the balls. This is illustrated in FIG. 1 where it will be seen that the bottom of the hopper 21 is formed of the notched cylinder 26 so that movement of the cylinder across the otherwise open bottom of the hopper will cause successive straws from the hopper to fall into the notches 27 and be moved onto the chains 28 and 29 to then be transported individually therefrom rearwardly of the housing. The forward lower part of the hopper is preferably formed of an angled plate 42 mounted on a pivot arm 43 with the plate 42 resting upon the cylinder 26 so that rotation of the cylinder 26 with the chains thereabout will cause the pivoted plate to ride over the notched cylinder periphery and thus vibrates the straws in the hopper to overcome any tendency of same to stick together or lodge in a fixed position. This assists in feeding the straws into the cylinder notches and thence onto the transport chains whereby successive straws are moved from the hopper upon the chains.

The housing 11 is divided into a plurality of transverse compartments by successive partitions 46, 47, 48 and 49 extending transversely of the upper portion of the housing and mounted on the back wall 12. Transverse support beams 51 mount the chain guides 36. The separate transverse compartments hereof are open to the bottom of the housing which forms a sump 52 and the chains 28 and 29 pass across the bottom of these compartments immediately beneath the partitions 46 to 49.

The first cycle of the present invention following removal or transport of successive individual straws from the hopper is that of cleaning disinfecting. This is accomplished in a compartment 56 disposed between the partitions 46 and 47. Within this compartment 56 there are mounted a pair of scrub brushes 57 and 58 which may be formed with hollow shafts slidably mounted upon driven shafts 59 with a pin through the latter engaging a cutout on the brush shafts for rotating the brushes.

Provision is made for maintaining the straws at a desired height within the compartment 56 and successive compartments by mounting a strip 66 along the back wall 12 of the housing with such strip having a U-shaped projection 67 longitudinally thereof along one half of the chamber and within which one end of the straws rides. Within the U-shaped projection there are preferably provided upper and lower flexible strips 68 between which the straw ends move to grip the ends of the straws and hold them in desired vertical position as they move through the compartments. The straws are prevented from bouncing upwardly from the chains by hold-down strips 71 and 71' extending between the partitions 46 and 47 immediately above the straws 41 on the chains and spaced apart so as to engage the straws if they should attempt to rise from the chains. A central low transverse wall 72 extends across the chamber 56 between the brushes 57 and 58 and the hold-down strips 71 and 71' are engaged therewith as by extension into slots therein with strips 71 in the first part of the compartment laterally offset with respect to strips 71' in the second part in order that the brushes shall engage all of the straw exteriors as the straws pass through the compartment.

The brushes and straws in the compartment 56 are subjected to a "rain" of cleaning and disinfecting fluid fed through an apertured tube 76 disposed transversely of the chamber between and above the brushes 57 and 58. Thus the exteriors of the straws are scrubbed by the brushes in passage through the chamber 56 while the cleaning and disinfecting fluid is directed onto the brushes. The interiors of the straws are also cleaned and in this respect reference is made to FIG. 2 wherein it will be seen that each straw in passing through a first portion of the chamber 56 is disposed with one end between the resilient strips 68 of the U-shaped projection 67 on strip 66 and the other end is engaged by a retainer strip 77 extending longitudinally of the chamber 56 and engaging only the top of the straw so that the center opening thereof is left unobstructed.

The interior of the straws are washed by the passage of cleaning and disinfecting material therethrough and to this and the strip 66 is provided with a plurality of small openings 81 therethrough aligned with the centers of the straws 41 in passage through the compartment 56. Fluid is supplied to the openings 81 under pressure from a pipe 82 threaded into a boss on the back wall 12 of the housing. An opening 84 in the back wall communicates between the pipe 82 and a longitudinal recess 85 in strip 66 communicating with the small orifices 81 that are aligned with the centers of the straws so that liquid cleaner and disinfectant supplied to the pipe will be forced through the straws to exit therefrom at the far ends of the straws, as indicated by the small arrows in FIG. 2.

It will be seen that the straws are successively transported by the chains 28 and 29 through the cleaning and disinfecting compartment 56 while such straws are maintained in fixed orientation to each other. The straws are prevented from lateral motion by fitting between the bottom of the U-shaped mwmvwe 67 on a strip 66 and the retaining strip 77 in the first portion of chamber 56, while the straws are prevented from moving up and down by the hold-down strips 71 and the first ends of the straws are maintained in alignment with the orifices 81 by the resilient strips 68 in the U-shaped member 67. In the latter portion of the chamber 56 the U-shaped projection 67 is omitted and the hold-down strips are offset so that all parts of all straws are scrubbed. Of course the balls 31 on the chains prevent movement of the straws longitudinally of the chains and consequently the only movement possible for the straws relative to the chains is a rotary motion which is, in fact, caused by the brushes 57 and 58 rotated at a speed much greater than the speed of translation of the straws by the chains. The brushes 57 and 58 may be rotated counterclockwise with the peripheral velocity thereof substantially greater than the translational velocity of the chains so that the brushes not only scour the straws as they pass through the compartment 56 but also rotate them so that all portions of the exterior of the straws are in fact cleaned and scrubbed.

Figure 3:
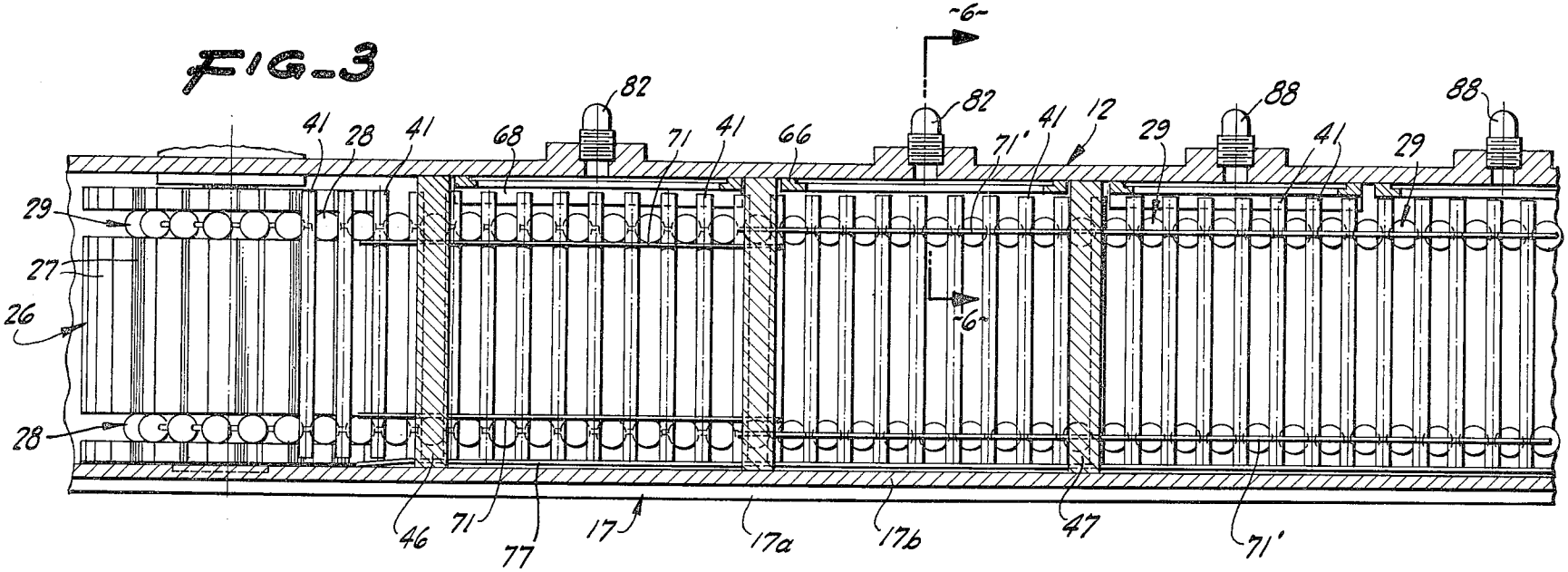
FIG. 3 is a partial sectional view taken in the plane 3—3 of FIG. 2.

Following the cleaning and disinfecting compartment 56 there is provided a rinse compartment 86 disposed between the partitions 47 and 48. Within this rinse compartment there is transversely disposed a slotted or perforated pipe 87 having one end extending through the ball wall 12 of the housing and the other end capped. Clean water or other fluid rinse is supplied through this pipe 87 and is sprayed downwardly upon the straws 41 transported across the bottom of the compartment 86 by the chains 28 and 29. Within the rinse chamber 86 there is also provided an extension of the strip 66 and all elements thereof in the first part of the chamber 86 whereby the straws in the rinse compartment have one end thereof passing between the strips 68 and clean water pipes 88 force filtered water through the slits 81 into the straws in the rinse compartment to thus rinse out the inside of the tubes therein. This structure of the rinse compartment is not illustrated inthe drawings inasmuch as it is the same as the structure in the cleaning and disinfecting compartment as illustrated in FIGS. 2 and 3.

Following complete rinsing of the straws as they pass through the rinse compartment 86, the present invention provides for completly drying the straws both internally and externally thereof. To this end there is provided an internal drying compartment or chamber 91 between the transverse partitions 48 and 49. This compartment may be quite short in length and includes wiping means 92 which may take the form of a plurality of thin strips of resilient material such as rubber, secured along the upper edges thereof to the lower portion of the partition 48 in the compartment 91 so that the lower edges of these resilient strips depend transversely across the compartment. As the chains move the straws 41 past the strips 92, the straws will be wiped by the strips to remove droplets of water adhering to the exterior of the strips. Following this wiping operation in the compartment 91, there are provided one or more fine orifices 93 aligned with the ends of the straws as they pass across the bottom of the compartment and high pressure air is applied through these orifices to thus blow as a jet forcibly through the interior of the straws and thus remove droplets of water that may remain therein.

Following the inner drying compartment 91 there is provided an outlet hopper 96 disposed between the partition 49 and end wall 14. This hopper has an upwardly inclined floor 97 with longitudinal slots therein through which the chains 28 and 29 pass so that movement of the chains through the hopper causes the straws carried thereby to be pushed onto the inclined floor upwardly from the chains as they pass through the inclined floor so as to leave the cleaned and disinfected straws in the hopper. The straws will thus pile upin the hopper, as shown, while yet in parallel alignment with each other and the back wall 12 of the housing at the hopper is formed with a large number of perforations, such as by the insertion of a screen 98 in a large opening therein with warm air being blown therethrough so as to complete drying of the straws in the hopper. The front wall 17 is also perforated at the exit hopper in order for this air to readily escape from the housing.

Provision is also made in the present invention for the automatic loading of magazines or the like with cleaned, disinfected and dried straws. To this end the housing is provided with means for receiving a magazine 101 immediately above the exit hopper 96. The magazine 101 has a slidably disposed bottom wall 102 which may be retracted, as illustrated in FIG. 1, to leave the interior of the magazine open to the hopper at the top thereof. The magazine 101 may also include an apertured flange 103 for fitting about a bolt and nut 104 on the housing to lock the magazine onto the housing. As the straws pile up in the hopper they will thus be moved upwardly into the magazine following the complete drying operation in the exit hopper. At such time as the magazine is filled or filled to desired capacity the floor 102 is then slid into closing position to the magazine so that the latter may be removed from the apparatus with straws therein ready for further use. Such a magazine may then be emptied into straw filling apparatus such as that disclosed in U.S. Patent Application Ser. No. 384,937 without the straws being touched by human hands since they were placed in the inlet hopper of the present invention.

Figure 4:
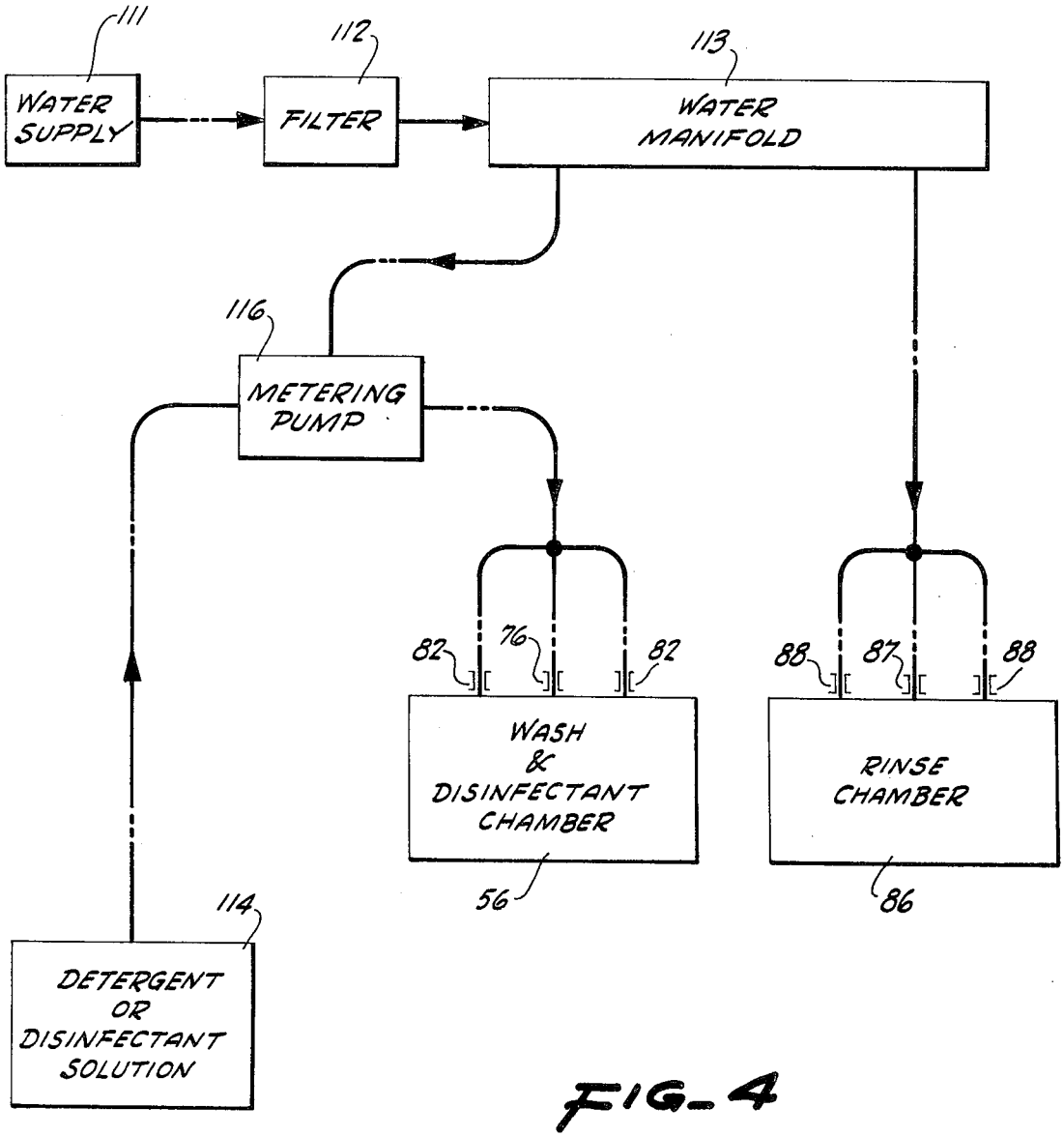
FIG. 4 is a schematic flow diagram in accordance with the present invention.
Figure 7:
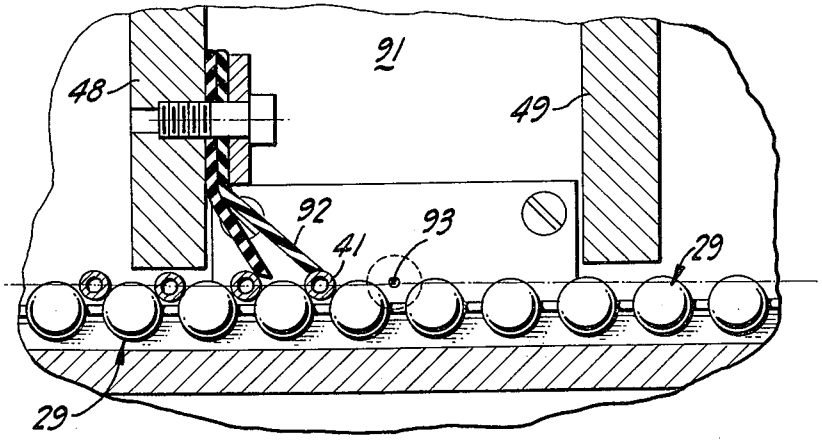
FIG. 7 is an enlarged sectional view taken in the plane 7—7 of FIG. 5.

The mechanical configuration of a preferred embodiment of the present invention has been described above and reference is now made to FIGS. 4 and 5 illustrating the flow of fluid in the apparatus hereof and the drive means for elements of the apparatus. Preferably cleaning and rinsing of the straws and the apparatus of the present invention is accomplished with water, although some other type of fluid can be employed. A water supply 111 is shown to pass water under pressure through a filter 112 into a manifold 113. A source 114 of detergent or other cleansing means and disinfectant solution is connected to one inlet of a conventional metering pump 116 having the other inlet connected to the manifold 113 so as to provide a controllable desired mixture of cleanser, disinfectant and water which is then discharged from the pump to the tube 76 and inlet pipes 82 of the cleaning and disinfecting chamber 56. Clean, fresh water from the manifold 113 is also connected directly to the inlet pipes 87 and 88 of the rinse chamber. It will thus be seen that water containing a cleanser and disinfectant is forced into the chamber 56 through the pipes 76 and 82 for the purposes described above and also clean water is forced under pressure through the pipes 87 and 88 into the rinse chamber 86 for rinsing the inside and outside of straws.

Figure 5:
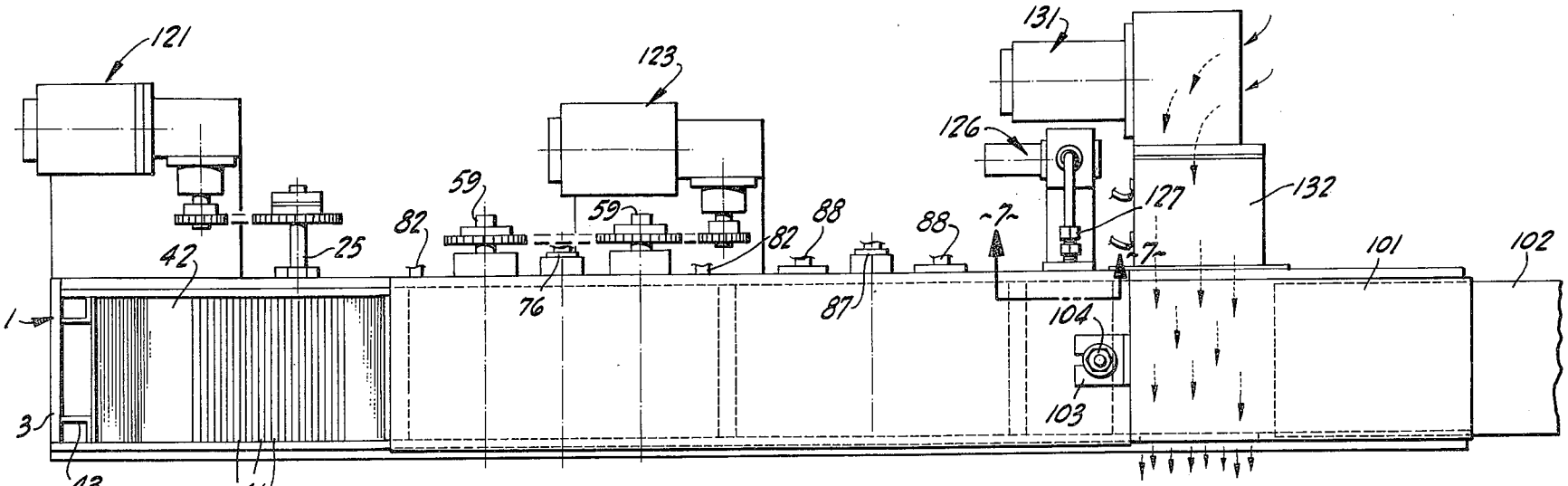
FIG. 5 is a schematic plan view of the apparatus of the present invention.

The chains 28 and 29 are moved across the bottoms of the above-described compartments by rotation of one of the notched cylinders 26 or 33 and in FIG. 5 there is shown a motor 121 disposed exteriorly of the housing 11 and driving the shaft 25 of the notched cylinder 26. This connection of motor and shaft may be made in any one of a variety of ways such as by gears, belts, chains or the like, and the motor may be variable speed motor with control means thereon for adjusting the rate of travel of the chains through the apparatus of the present invention. Preferably a clutch 122 is included in the drive train so that no undue damage could result from possible jamming of the apparatus. The brushes 57 and 58 of the present apparatus are rotated as, for example, by an exterior motor 123 through a chain drive or the like into connection with the brush shafts 59. The interior drying of the straws in the chamber 91 is accomplished by a high velocity jet of air forced through the straws and such jet is preferably provided by a separate high velocity blower 126 mounted exteriorly of the housing at the back wall 12 thereof and having an outlet pipe 127 extending through such wall into communication with the jets 93 within the chamber 91. The final drying of the straws in the outlet hopper 96 is accomplished by the passage of heated air longitudinally of the straws therein and to this end there is provided a blower 131 passing air through a heater 132 and exhausting through the perforated opening in the back wall of the housing at the outlet hopper 96.

The liquids employed in the apparatus of the present invention will be seen to fall from the chambers 56 and 86 into the sump 52 at the bottom of the housing inasmuch as there are no floors provided in these chambers. The sump 52 is preferably provided with a low point in the bottom thereof so that liquid may be readily drained from the sump, as shown.

It will be appreciated that the present invention, as described above in connection with a preferred embodiment thereof, operates to thoroughly clean, disinfect and dry poultry insemination straws without the necessity of any human intervention. The apparatus is fully automatic so that a large number of straps may be passed therethrough to provide necessary high output for this field. Additionally the apparatus hereof provides for automatic loading of magazines with the dry, clean straws so that the latter may then be readily employed in further artificial insemination operations without the necessity of handling same and this is advantageous in reducing the risk of possible straw contamination by human handling.

Although the present invention has been illustrated with respect to a single preferred embodiment, it will be apparent to those skilled in the art that various modifications and alterations may be made in such showing without departing from the concepts of this invention. It is thus not intended to limit the invention to the precise details of illustration nor terms of description.

What is claimed is:

1. Apparatus for cleaning and disinfecting small straws employed for artificial poultry inseminations comprising a pair of parallel endless chains having spaced depressions thereon for receiving straws to be carried thereby and extending over first and second rotatably mounted cylinders with one cylinder being driven to thus move said chains together for transporting straws, means holding straws on said chains, at least one rotary mounted brush disposed at a first station above said chains in position to scrub straws carried by said chains past the brush, means directing cleaning disinfecting fluid onto said straws and through said straws at said first station, means defining a second station through which said chains pass and including means directing a rinse fluid onto and through straws carried by said chains, and straw drying means directing a jet of air through rinsed straws on said chains and directing air onto the exterior of said straws.

2. The apparatus of claim 1 further defined by a first of said cylinders having peripherally spaced longitudinal notches thereabout dimensioned to receive straws therein and having circumferential grooves wherein said chains wrap around the cylinder whereby straws are carried by the cylinder grooves onto said chains for transport by the chains.

3. The apparatus of claim 1 further defined by an inlet hopper having said peripherally notched cylinder forming the bottom thereof and an angled front wall pivotally mounted to ride upon said cylinder and thus to pivot up and down as the wall rides into and out of cylinder notches to vibrate straws placed in the inlet hopper.

4. The apparatus of claim 1 further defined by a pair of elongated U-shaped chain guides disposed one beneath each chain along the upper extension thereof between said cylinders and the means holding chains comprising thin parallel spaced strips extending longitudinally of the chains immediately above same and laterally staggered in said first station.

5. The apparatus of claim 1 further defined by said first station including at least two rotary driven brushes mounted to engage straws carried by said chains, said means directing cleaning and disinfecting fluid including a U-shaped retainer disposed along the outside of a first of said chains partially through said first station whereby the ends of straws are engaged thereby with means defining small openings therein aligned with the interior of straw ends moved along the retainer by the chains and means ejecting a cleaning and disinfecting fluid through said small openings for passage thereof through said straws, and said means holding said straws including a retainer strip disposed along the outside of a second of said chains in position to engage the ends of straws on the chains only at the upper portion of the chains.

6. The apparatus of claim 1 further defined by an outlet hopper having a slotted floor inclined upwardly in the direction of chain travel with said chains extending through said slotted floor whereby straws move off of the chains onto the hopper floor as the chains move and means for receiving a straw magazine having a movable bottom in closing relation to the open top of said outlet hopper for automatic loading of a magazine by upward movement of straws in said hopper.

7. The apparatus of claim 1 further defined by a housing enclosing said cylinders, chains, first and second stations and drying means with said housing having an inclined floor and a drain at the lower point thereof for drainage of fluids from said housing, said housing having transverse support beams mounting chain guides disposed longitudinally beneath the upper traverse of said chains and transverse partitions defining said first and second stations above said chains.

* * * * *